US005947437A

United States Patent [19]

Tate et al.

[11] Patent Number: 5,947,437

[45] Date of Patent: Sep. 7, 1999

[54] RIGID MOUNTING CORNERS ATTACHABLE BY MAGNETIC OR SHARPENED MEANS

[76] Inventors: Joseph L. Tate; Helen B. Tate, both of 4215 NW 20th Dr., Gainesville, Fla. 32605

[21] Appl. No.: 08/321,392

[22] Filed: Oct. 11, 1994

Related U.S. Application Data

[63] Continuation-in-part of application No. 08/093,605, Jul. 19, 1993, abandoned.

[51] Int. Cl.[6] ..... A47G 29/02

[52] U.S. Cl. ..... 248/467; 248/216.1

[58] Field of Search ..... 248/467, 475.1, 248/345, 216.1, 216.4, 205.2, 488, 546; 40/159.1, 152.1

[56] References Cited

U.S. PATENT DOCUMENTS

| | | | |
|---|---|---|---|
| 1,194,217 | 8/1916 | Murray | 40/159.1 X |
| 1,463,740 | 7/1923 | Gee et al. . | |
| 1,506,215 | 8/1924 | Beshgetoor . | |
| 1,516,264 | 11/1924 | Bliss . | |
| 1,624,741 | 4/1927 | Leppke et al. . | |
| 1,633,859 | 6/1927 | Harvey | 40/159.1 |
| 1,845,327 | 2/1932 | Paget . | |
| 1,852,744 | 4/1932 | Engel | 40/159.1 |
| 1,856,160 | 5/1932 | Gutberlet | 40/159.1 X |
| 1,970,395 | 8/1934 | Schaake | 40/159.1 |
| 2,085,187 | 6/1937 | Engel | 40/159.1 |
| 2,659,169 | 11/1953 | Brennan . | |
| 2,825,166 | 3/1958 | Flood . | |
| 3,031,799 | 5/1962 | Bradsby . | |
| 3,124,501 | 3/1964 | Wise . | |
| 3,187,449 | 6/1965 | Longo et al. . | |
| 3,245,165 | 4/1966 | Podoloff . | |
| 3,298,124 | 1/1967 | Jahn . | |
| 3,346,979 | 10/1967 | Milos . | |
| 3,370,818 | 2/1968 | Perr | 248/205.2 |
| 4,179,089 | 12/1979 | Parr, Jr. | 248/216.1 |
| 4,268,000 | 5/1981 | Ulm | 248/467 |
| 4,479,318 | 10/1984 | Rusell | 40/159.1 X |
| 4,525,115 | 6/1985 | Garner, Sr. | 411/457 |
| 4,529,278 | 7/1985 | Nugent | 248/467 X |
| 4,785,562 | 11/1988 | Good | 40/159.1 |
| 4,837,953 | 6/1989 | Tannenbaum . | |
| 4,838,793 | 6/1989 | Taylor . | |
| 5,199,681 | 4/1993 | Reidy | 248/216.1 X |
| 5,255,458 | 10/1993 | Piel | 40/159.1 |

*Primary Examiner*—Ramon O. Ramirez
*Attorney, Agent, or Firm*—Julian C. Renfro, Esq.

[57] ABSTRACT

A mounting corner usable with several other like mounting corners for the mounting of photographs, posters, drawings and the like on a mounting surface, this mounting corner being constructed from relatively thick, rigid material, and having substantially flat, triangularly-shaped front and rear surfaces. Two edge portions of the front and rear triangularly-shaped surfaces meet at a right angle, whereas the hypotenuse edge of each mounting corner is slotted to receive the respective corner of a photograph, poster, drawing or the like. Securing means selected from a variety of different types is utilized upon the rear surface of each mounting corner, thus enabling our mounting corner to be attached to a mounting surface of ferric metal, as well as upon surfaces such as wood, felt-board, cork, ceramic and the like, depending upon the particular securing means utilized in a given instance. Preferred securing means include magnetic material attached by adhesive means upon the rear surface of each mounting corner, when the corner is to be utilized upon a ferric metal surface, and a sharpened point held in place by a spring clip attached in the slotted hypotenuse edge, for a mounting corner intended to be used upon a corkboard, panel board or the like.

3 Claims, 3 Drawing Sheets

RIGID MOUNTING CORNERS ATTACHABLE BY MAGNETIC OR SHARPENED MEANS

RELATIONSHIP TO PREVIOUS APPLICATION

This is to be regarded as a Continuation-in-Part of our patent application entitled "RIGID MOUNTING MEANS ATTACHABLE TO A VARIETY OF SURFACES," Ser. No. 08/093,605, filed Jul. 19, 1993, now abandoned.

BACKGROUND OF THE INVENTION

Most persons having an interest in photography are familiar with mounting corners provided with securing means on the rear side thereof, that have been used for many decades in the mounting of photographs, pictures and the like, and by way of illustration, the Murray U.S. Pat. No. 1,194,217 of Aug. 8, 1916 pertains to the use of corner pockets 14 " . . . constructed from any suitable material . . . ." Provided on the rear face of each corner pocket 14 of Murray is a stick pin 15. As pointed out by this patentee, attachment is accomplished by the points being forced into " . . . the wall of the standing structure . . . ", and this reference pertains to no mounting means other than the use of the sharpened point.

By remarking that his corner pockets 14 can be "constructed from any suitable material," Murray manifestly does not have in mind the use of mounting corners " . . . constructed from relatively thick, rigid material . . . ," as is involved in the present invention.

Regarding the embodiment of our invention directed to the use of magnetic means for securing the magnetic corners to surfaces of ferric material, the Bliss U.S. Pat. No. 1,516,264 utilizes U-shaped magnets of substantial size, clearly intended to be used in a central portion of the backside of a picture. Bliss' magnets are not in any manner adaptable for the use on the backside of triangularly shaped mounting corners of rigid construction, and the Bliss concept would not appear to logically be able to be transferred to a teaching directed to the construction of mounting corners.

A prior art patent more directly illustrative of mounting corners is the Flood U.S. Pat. No. 2,825,166 entitled "Strip of Corner Mount for Mounting Pictures and the Like," which issued Mar. 4, 1958, and another relevant patent is the Milos U.S. Pat. No. 3,346,979 entitled "Combined Negative and Photograph Corner Mounting," which issued Oct. 17, 1967. Both of these patents pertain to mounting corners involving the use of relatively flexible material.

A corner mount of a different character is set forth in the Parr, Jr. U.S. Pat. No. 4,179,089 entitled "Apertured Panel Corner Mount Fastener for Concrete Walls," which issued Dec. 18, 1979. This patent involves the use of relatively rigid material, but it contains a series of pins that the user is to drive into a concrete wall or the like. Like the others, the Parr teaching is of no particular consequence to the instant invention.

The Good U.S. Pat. No. 4,785,562 entitled "Magnetic Display Holder" teaches the display of sheet material such as a child's drawing, a sheet of scheduled events, photographs or the like upon a metal surface, such as a refrigerator door. The units proposed by Good are designed to hold photographs by retaining the photo between the frame and the metal surface. One would have to use Good's "L" framed units to display a photograph or any material with a stiffness factor greater than most photographs.

Flexible sheets of display material such as typing paper, coloring book sheets, newspaper articles or the like, can be mounted in the frame represented by Good's FIG. 2. To use the frame represented by his FIG. 2, the display material would have to be cut to the size of the frame and be flexible enough to have the corners inserted into the corner slots. If the display sheet is not flexible enough, damage to the display sheet will be caused by bending the corners into the slots, or else the material will hold the frame away from the metal surface, which would cause the magnetic properties of the frame to be ineffective.

The section frame as represented in Good's FIGS. 4*a*, 4*b*, 4*c* and 4*d* has the advantage of accommodating display material of different sizes. It also has the disadvantages of the frame in accordance with Good's FIG. 2, for the display material must be flexible enough to have the corners folded into the corner slots such as not to crease or damage the material. Also, if the material is somewhat thicker, such as most photo material or photos with backing material or posterboard, the sectional corners cannot compensate for the thicker display material inserted in the slots at the necessary angles, thereby defeating the entire purpose behind the use of the magnetic units. The Good invention is thus very limited in its tolerance for display materials of any significant thickness.

In view of the fact that in each of Good's embodiments, a magnet is utilized in close association with a corner section of considerable size, a substantial amount of expense as well as packaging difficulties will necessarily be involved in the use of the Good device.

It was in an effort to improve upon these and other such devices of the prior art, and to expand the use of mounting corners, that the present invention was created.

SUMMARY OF THE INVENTION

In contrast to the Good invention, it will hereinafter be seen that the instant invention enables display material of any size and thickness to be accommodated. Importantly, the present invention does not require any folding or bending of the display material. Our system in effect encapsulates the display material into its own fully enclosed cavity and does not depend on sandwiching the display material between the frame and a metal mounting surface. The instant system will accommodate a variety of mounting surfaces, but one preferred embodiment of our invention involves mounting corners utilized with magnetic backing for adherence to ferric metal surfaces, and another preferred embodiment utilizes a point in the nature of a thumbtack point, for fastening our mounting corners to wood or bulletin board material. Other less significant embodiments involve the utilization of VELCRO material for fastening our mounting corners to cloth material such as office divider walls, as well as small suction cups for fastening on glass, tile, or mirrored surfaces.

Inasmuch as our novel mounting corners are of sturdy, flat, rigid material, it is quite clear that the instant invention is structurally different from the prior art in design and method of use, and it is also apparent that the function of the instant invention in its method of accepting of display material is much improved over the prior art. The material and production costs of the instant invention are substantially less than devices in the nature of the Good invention, while maintaining a more aesthetic appeal.

It is quite clear that we have gone further than any of the earlier mentioned patents, for we have made mounting corners of sturdy construction and tangible thickness, with the basic thought of enabling people to mount photographs, posters and the like securely on a refrigerator door, a file cabinet, on a poster board, felt board and the like, in a tidy and organized manner.

As will hereinafter be seen in greater detail, the primary embodiments of this invention involve a mounting corner usable with a group of like mounting corners in the mounting of such items as photographs and posters. Our relatively thick mounting corners may for example be of one-piece construction, involving substantially flat, triangularly-shaped front and rear surfaces, we well as having two edge portions meeting at a right angle. Importantly, the hypotenuse edge is slotted to receive the corner of a photograph or poster. In order that several of our novel mounting corners could be used for supporting a photograph or poster in a suitable location, appropriate mounting means or securing means are located on the rear surface of each corner.

In one primary embodiment, the mounting means or securing means is a layer of magnetic material, enabling four of these mounting corners to be utilized for mounting a poster, a photograph of substantial size, or a calendar on a refrigerator, file cabinet, metal door, or other such item made of ferric material, whereas in accordance with another important embodiment, we may use securing means in the form of a sharpened point on the rear side of each corner, held in place by a novel mounting clip.

As will be discussed at length hereinafter, we can construct one-piece plastic mounting corners by extrusion techniques, so as to create properly slotted corners of one-piece construction. As an alternative to the one-piece construction, each corner may comprise a thick front member, a thick rear member, and means for separating the front and rear member so as to define a slot between the front and rear members, into which slot the corner of a photograph, bulletin, poster or the like can be inserted. Because the rear side of each corner of one primary embodiment is equipped with its own magnet, photographs from small snapshots to 8"×10" photographs (or even larger) can readily be mounted on such locations as the door of a refrigerator or a file cabinet. Another item illustrative of the use of our devices are a page from a calendar, thus enabling the user to diagram all the events of the month. Other items of this general nature will be apparent to those skilled in this art.

A primary object of our invention is therefore to provide a mounting corner, utilized for example in groups of four, which corner is of sturdy, rigid construction, and readily secured on a variety of vertically disposed mounting surfaces.

Another object of our invention is to provide a self-sustaining mounting corner that is of relatively thick, generally triangularly shaped construction, with the hypotenuse portion of the corner slotted to receive the corner of a photograph, poster or the like.

A further object of our invention is to provide a sturdy mounting corner having mounting means affixed to the backside, which may involve the use of magnetic material for being affixed to a ferric metal surface, or the use of a sharp point for penetrating a corkboard or wall panel, held in place by a novel spring clip.

A still further object of our invention is to provide a sturdy, rigid mounting corner utilizing a securing means on the rear side thereof in the nature of magnetic material held in place by adhesive means.

A yet further object of our invention is to provide a novel rigid mounting corner of triangular configuration, formed either by injection molding, or of separate components secured together so as to form in the hypotenuse of such mounting corner, a slot for receiving the corner of a photograph, poster or the like.

These and other objects, features and advantages will be more apparent from a study of the appended drawings.

BRIEF DESCRIPTION OF DRAWINGS

FIG. 10 is a perspective view of a mounting corner in accordance with an important embodiment of our invention, utilized in conjunction with a clip-supported sharpened point enabling our corner to be used on a corkboard, bulletin board or the like;

DETAILED DESCRIPTION

Figure 1:
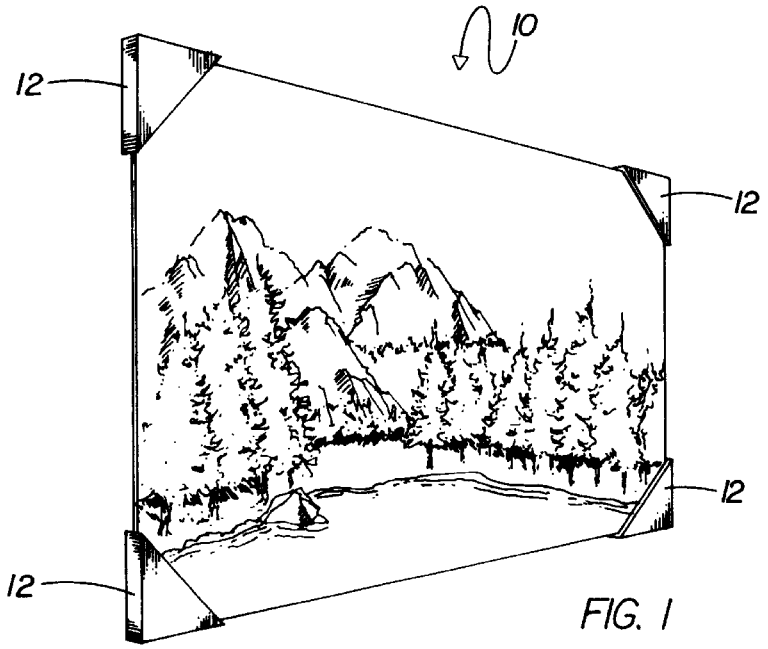
FIG. 1 is a perspective view illustrating the use of four of our novel mounting corners for affixing a photograph or drawing in place on a mounting surface.

With initial reference to FIG. 1, it will be seen that we have illustrated a photograph, drawing or poster 10 held in place by a plurality of our novel mounting corners 12. It is to be understood that a mounting corner in accordance with this invention may utilize any of several different mounting means or securing means, in order that our novel, self-sustaining mounting corners can be used for securing the photograph, drawing or poster on a wall, corkboard, panel board or the like, or even on the front or side of a metal surface such as a refrigerator or file cabinet, depending upon the particular securing means utilized on the backside of the mounting corners.

Inasmuch as it is desired for each of our novel mounting corners to have a considerable substance or rigidity apart from the surface upon which it is to be used, each corner 12 is made of relatively thick, rigid material, for example a hard, rigid plastic, such as styrene. As an example, the thickness of our mounting corners can be between ⅛ inch and ⅜ inch, with a preferred thickness being 3/16 inch, but we are not to be limited to this.

Figure 2:
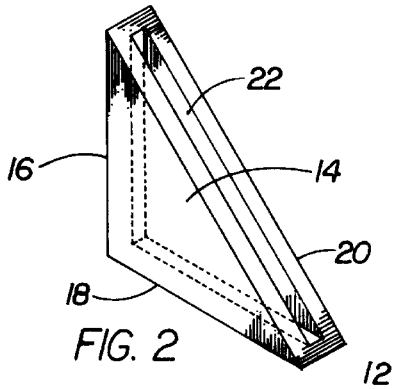
FIG. 2 is a frontal perspective view to a relatively large scale, of a typical mounting corner in accordance with our invention, with this view revealing the front surface of a triangularly-shaped mounting corner, as well as the slot located in the hypotenuse portion of the mounting corner, into which slot the corner of a photograph, poster, bulletin or the like is inserted.

From the standpoint of an individual corner, and with regard to FIG. 2, a mounting corner 12 in accordance with this invention has a substantially flat, triangularly-shaped front surface 14, bounded by edges 16 and 18. Also visible in FIG. 2 is the hypotenuse portion 20 of the corner, in which a slot 22 is located. It is into the slot 22 that a corner of a drawing, photograph or poster is inserted.

Figure 3:
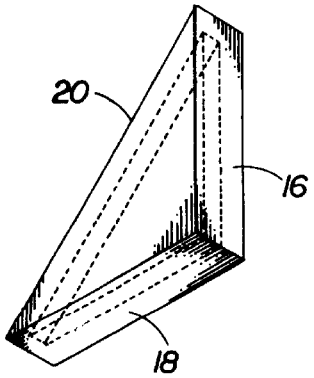
FIG. 3 is a perspective view of the mounting corner of FIG. 2, taken so as to reveal the two edge portions remote from the hypotenuse portion of the mounting corner, which edge portions meet in a right angle.

FIG. 3 reveals that the edges 16 and 18 opposite the hypotenuse edge 20 meet at a right angle.

Figure 4:
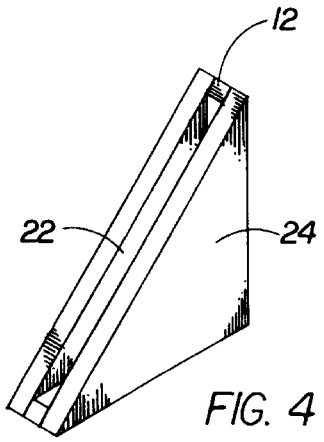
FIG. 4 is a perspective view of the rear surface of the mounting corner, upon which a selected one of several possible mounting means or securing means is utilized, so that the mounting corner may be attached to a desired surface.

With reference to FIG. 4, it will be seen that this figure reveals the rear surface 24 of a mounting corner in accordance with one aspect of this invention, with it to be understood that upon this surface, a selected securing means or mounting means can be attached, such as by glue, cement or adhesive, double sided tape, or the like. The several optional means available for use in accordance with our novel mounting corners will be discussed shortly.

In accordance with another aspect of this invention, we may extrude our novel mounting corners out of magnetic material, so that it becomes unnecessary to actually glue, cement, or otherwise secure a component, such as a thin sheet of magnet stock, to the rear side of the corner, to serve as the securing means. In accordance with our use of extruded magnetic material, we actually injection mold our novel mounting corners out of plastic into which a suitable percentage of magnetic powder has been infused. We are not to be limited to any particular percentage, but in one instance, we utilized approximately 75% magnetic powder by weight. The disadvantage of this arrangement is that the magnetic particles are abrasive, and this affects the life of the extrusion dies utilized therewith.

Figure 5:
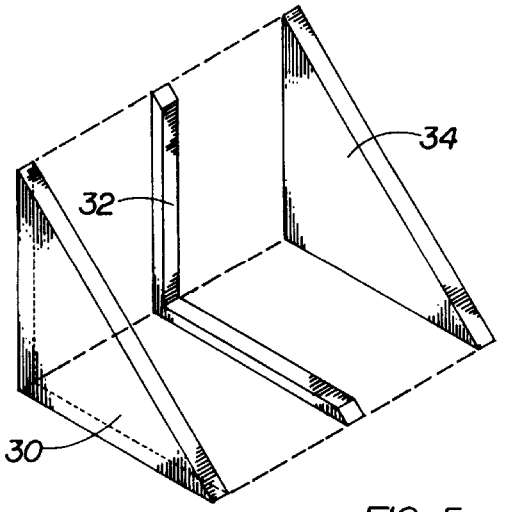
FIG. 5 is an exploded view revealing the manner in which one mounting corner embodiment can be constructed, which in this instance is a three-piece mounting corner.

FIG. 5 reveals in exploded relation, how one embodiment of a mounting corner in accordance with this invention may be constructed, and in this instance it is to be seen that we may construct each corner in three pieces. These three pieces involve triangularly-shaped pieces 30 and 34, which are maintained a desirable extent apart by the use of an L-shaped member 32. An appropriate glue or cement is applied to both of the outer surfaces of the L-shaped member 32 in order that they may be secured to the near surfaces of the members 30 and 34 in what may be regarded as a permanent manner, thus to create a composite mounting corner having a suitable slot into which the corner of a photograph or poster or another such item can be readily inserted.

Figure 6:
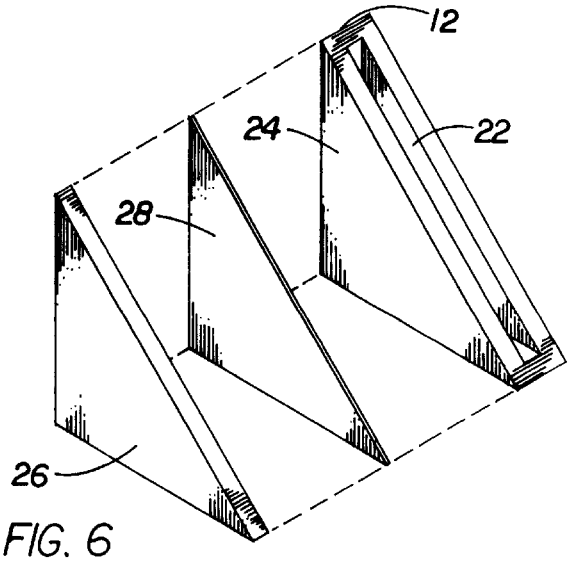
FIG. 6 is an exploded view revealing the manner in which a flat magnetic component can be applied to the rear side of a mounting corner in accordance with this invention.

As a first example of a preferred type of securing means or mounting means utilized on the rear side of each corner, reference is made to FIG. 6, wherein magnetic means 26 in the form of a thin triangle of magnetic material is attached or mounted on the rear side 24 of a typical rigid corner 12, to serve as the securing means. The magnetic material 26 may be secured in place by a triangularly shaped piece of double sided tape 28, but we prefer the utilization of magnetic material to which adhesive has already been applied by the manufacturer, with such adhesive being prevented from adhering to extraneous items or objects by the use of peel-away backer material applied to the backside of such magnetic material during or immediately after manufacture.

By the use of the magnetic material 26 secured directly upon the rear side 24 of the mounting corner by the adhesive previously applied to the magnetic material, and by virtue of a slot 22 being provided in the hypotenuse edge of each mounting corner, four of these mounting corners readily enable a poster, a photograph of substantial size, or a calendar to be mounted on a refrigerator, file cabinet, metal door, or other such item made of ferric material.

Figure 7:
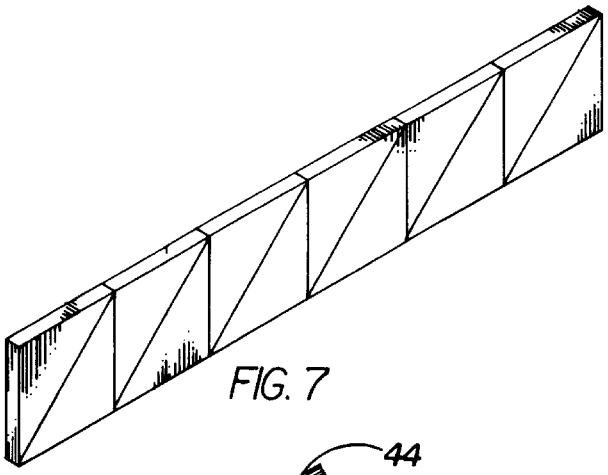
FIG. 7 is a magnet array, revealing how flat magnets with adhesive applied may be manufactured for application to the backside of our novel mounting corners, with peel-away material being utilized to protect the adhesive used on the magnetic material until the corner is ready for use.

In FIG. 7 we illustrate a series of relatively thin magnets constructed for use on the rear side of mounting corners created in accordance with this invention. A suitable type of adhesive or cement, such as an appropriate type of pressure sensitive adhesive material is applied by the manufacturer to the rear side of these magnets, so that the magnets may each be caused to readily adhere to the rear side of a mounting corner. The use of the peel-away backers on the pressure-sensitive material of the magnets is important in preventing such material from adhering to items with which they may be brought into unwanted contact.

Magnetic strip material with pre-applied adhesive protected by a peel-away backer is commercially available from such manufacturers as Adams Magnetic Products Company, 2081 N. 15th Avenue, Melrose Park, Ill. 60160. We understand that the adhesive used on their magnetic material is a product developed and patented by Minnesota Mining and Manufacturing, with such adhesive being designed to stay sticky for as long as the protective peel-off backer remains in place. We also understand that this adhesive material remains pliable for life.

We are not to be limited to magnetic strip material with adhesive applied as manufactured by Adams Magnetic Products, for such material of this nature provided by other manufacturers may well be suitable. We prefer to purchase the magnetic strip material in widths of ¾ inch, and in four-foot lengths, but other lengths may be appropriate in other circumstances. We subsequently cut the magnetic strip material into the triangular shapes as depicted in FIG. 7.

We have the option of performing either a so-called "kiss cut" in which the elongate strip of backer material remains intact throughout the procedure of cutting the magnetic material into the triangularly-shaped components, or else we can cut the triangularly-shaped magnetic components completely apart with, of course, the peel-away material still protecting the adhesive used on the rear side of each triangularly shaped magnetic component.

As is obvious, our novel thick, rigid mounting corners can be manufactured using mass production techniques, with the magnetic material thereafter being secured in place on the rear side of the mounting corners either by the manufacturer, or else by the purchaser. The purchaser of our novel mounting corners would have the option of either peeling away the backer from the adhesive previously applied to the magnetic material, and then applying the magnetic material to each mounting corner, or else applying to the rear side of each corner, a different type of securing means taught in accordance with this invention.

Figure 8:
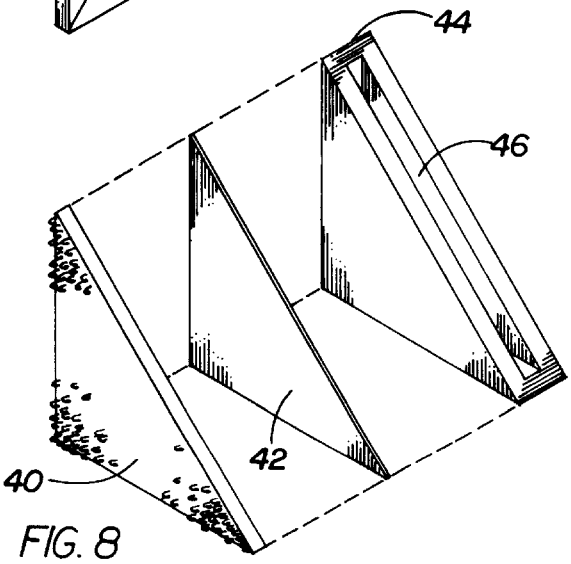
FIG. 8 is an exploded view revealing that a secondary embodiment of our mounting corners may utilize VELCRO as the securing means, such as hook type VELCRO held in place by double sided adhesive.

FIG. 8 reveals a secondary embodiment of a mounting means usable in conjunction with our corners, with this figure showing the use of a generally triangularly-shaped piece of hook-type VELCRO 40 on the rear side of each mounting corner 44, enabling photographs and posters and the like to be secured in a desired location on a felt board, or the like. Although we are not restricted to any particular procedure for securing VELCRO on the rear surface of the mounting corner 44, we have found that a triangularly-shaped portion of double sided tape 42 may be used in a particularly effective manner for this purpose. An alternative is the use of pressure-sensitive adhesive. A slot 46 is provided in the hypotenuse portion of the corner to permit the insertion of the corner of an item to be mounted on a vertical surface.

Figure 9:
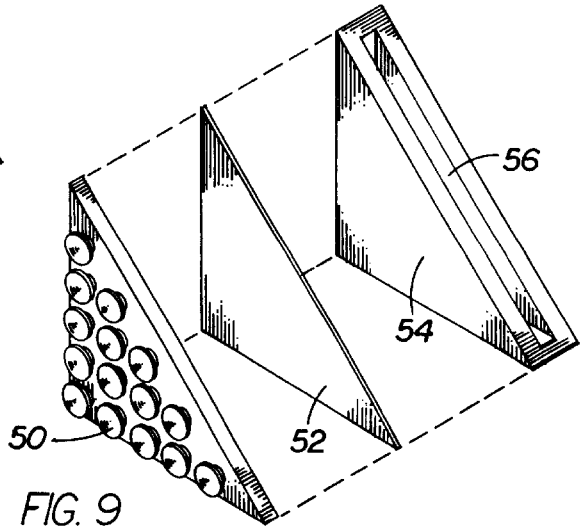
FIG. 9 is an exploded view revealing that another of the secondary embodiments of our mounting corners may utilize miniature suction cup material held in place by double sided adhesive.

FIG. 9 reveals another secondary embodiment of our invention, and as depicted in this figure, we can utilize miniature suction cup material 50 as the securing means, which suction cup material is held in place on the rear side of the mounting corner 54 by a triangularly-shaped portion 52 of double sided tape. However, we are not to be limited to this, and a suitable glue or cement may be used. A slot 56 is provided in the hypotenuse portion of the mounting corner to permit the insertion of the corner of an item to be mounted.

Figure 10:
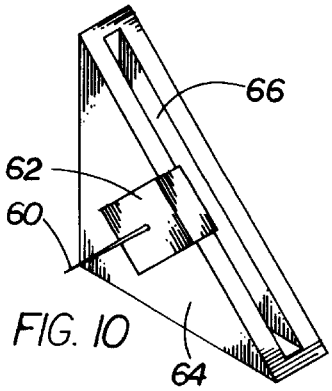
Figure 11:
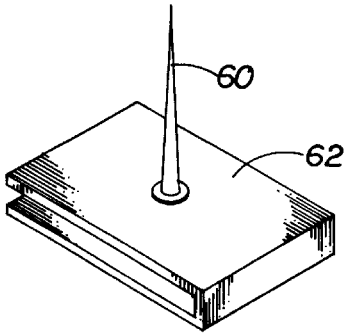
FIG. 11 is a view of a typical sharpened point in accordance with our invention, showing the use of the spring steel clip utilized for holding the sharpened point onto the mounting corner.

In FIG. 10 we depict another important embodiment of our invention, that is particularly suitable for mounting our novel mounting corners on a corkboard, wall panel or other such surface. In this instance, the securing means takes the form of a sharpened point 60 affixed to the rear side of the corner 64. As will be seen in this figure as well as in FIG. 11, the point 60 is mounted in a firm manner to a side surface of the clip member 62, which is preferably constructed of spring steel. As to be seen in FIG. 10, the clip member is inserted into the slot 66 located in the hypotenuse portion of the corner 64. The clip 62 is of such construction as not to interfere with the subsequent insertion of the corner of a photograph or poster.

As previously indicated, as one option for the securing means used, the purchaser can readily apply the sharpened points to the mounting corners by securing the clip members upon the rear component of each mounting corner.

Figure 12:
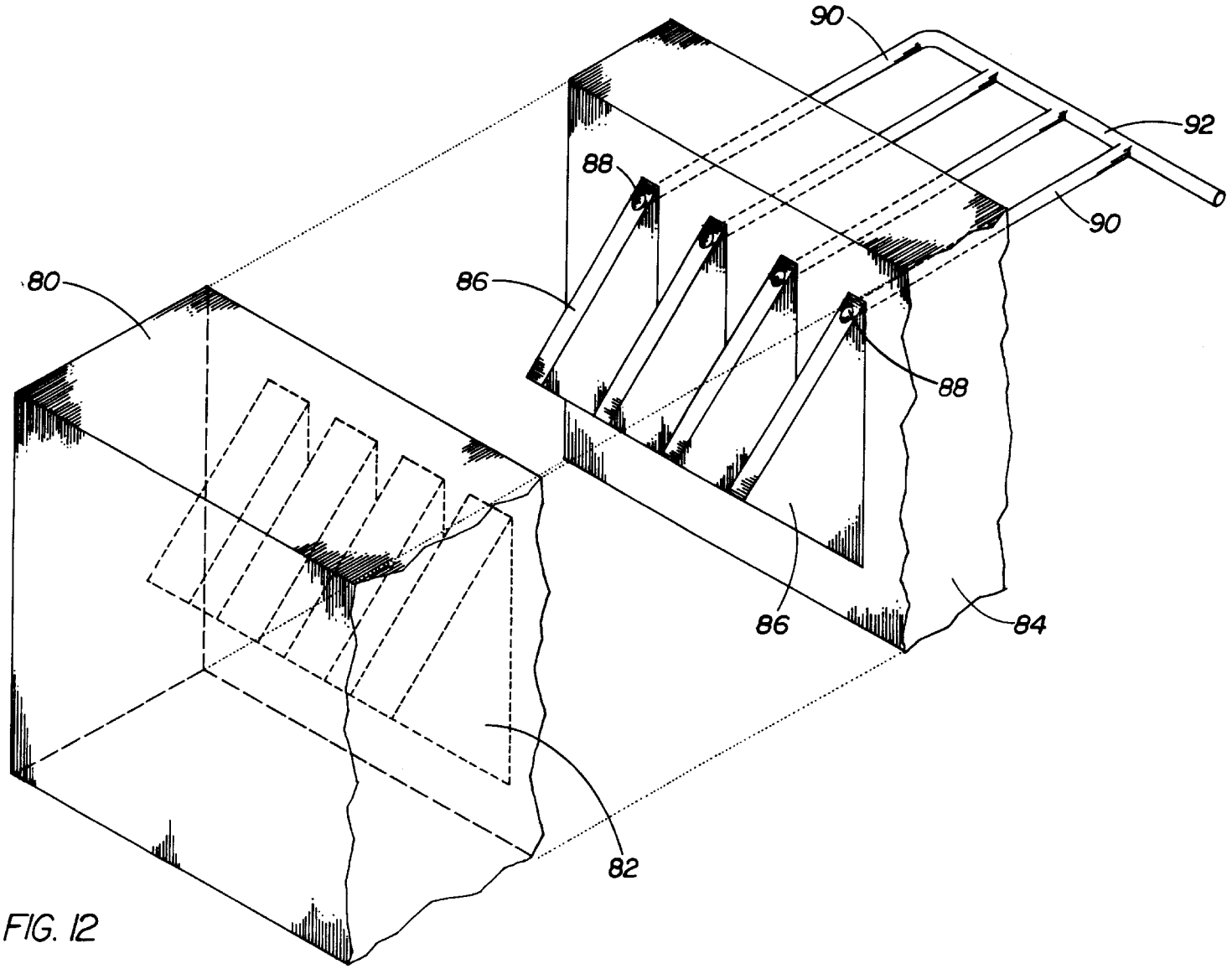
FIG. 12 is a schematic of an arrangement by which one-piece mounting corners, each containing a slot in its hypotenuse, can in accordance with this invention, be created by an injection molding procedure.

In FIG. 12 we reveal an arrangement by which one-piece mounting corners in accordance with this invention can be created, accomplished in such a manner that a suitable slot will be formed in the hypotenuse edge of each corner. As shown in this figure, a stationary platen 80 containing a series of triangularly-shaped cavities 82 is mounted in an operative relationship with a movable platen 84. The movable platen has a number of triangularly-shaped forming members 86, in one edge of each of which forming members, a hole 88 is located. It is to be understood that the lateral spacing of the forming members 86 is the same as the spacing of the triangular-shaped cavities 82 of the stationary platen 80.

The arrangement is such that when the platens are brought together into an operative relationship, the forming members 86 will extend into the cavities 82 in such a manner as to be equidistant from the sidewalls of the cavities. After securing the platens in an interfitted relationship, molten plastic of a suitable type may be injected under substantial pressure through the holes 88 into the space between the cavities 82, and the respective forming members 86.

It is to be understood that the forming members 86 do not completely fill the cavities 82, but rather reside in the cavities in such a way as to permit the formation of mounting corners having a suitable slot located between front and rear portions that are each of a consistent thickness, which front and rear portions are properly connected by rear edges such as shown at 16 and 18 in FIG. 3.

After the plastic has filled these cavities, it is allowed to cool to a sufficient extent, after which the movable platen is moved away from the stationary platen, so that the newly formed mounting corners can be removed.

It is to be noted that a pipe 90 from a common manifold 92 is connected to each of the holes 88 in the upper part of the forming members 86, with the manifold 92 being in turn connected to a source of molten plastic supplied under pressure to the common manifold. We are not to be limited to any particular arrangement of an injection molding apparatus, for machines of this type are well known in the art.

Although our rigid, self-sustaining mounting corners are not to be limited to any particular thickness, in one exemplary embodiment, the triangularly shaped components of the mounting corner 12 as depicted in FIGS. 2, 4 and 6 measured ¾ inch along each side, and had a total thickness of 3/16 inch. In this exemplary embodiment, the triangularly-shaped front and rear surfaces each were 1/16 inch thick, with a 1/16 inch slot 22 being located in the hypotenuse. Continuing with the same exemplary embodiment, the triangularly-shaped member 26 of magnetic material was 1/16 inch thick, thus bringing the total thickness of the mounting corner with the magnetic material attached to a thickness of ¼ inch. However, we are not to be limited to these dimensions.

Similarly, the triangularly-shaped piece of VELCRO 40 in FIG. 8 was ⅛ inch thick, as was the miniature suction cup material 50 depicted in FIG. 9.

Other securing means for our rigid, self-sustaining mounting corners may be utilized within the spirit of this invention, and we are not to be limited except as required by the scope of the appended claims.

We claim:

1. A mounting corner usable with other like mounting corners for the mounting of photographs or posters on a mounting surface, said mounting corner being constructed from relatively thick, rigid material, said mounting corner being approximately 3/16 inch thick and having substantially flat, triangularly shaped front and rear surfaces, said mounting corner having two edge portions meeting at a right angle, with the hypotenuse edge being slotted to receive the corner of a photograph or poster, and securing means attached to said rear surface for enabling said mounting corner to be secured to a mounting surface, said securing means involving a sharpened point adapted to be inserted into a corkboard or panel, said sharpened point being firmly mounted on a spring clip supported by said slotted edge of the hypotenuse of said mounting corner.

2. A mounting corner to be utilized in groups for the mounting of photographs or posters, said corner comprising a rigid, generally triangularly shaped front member, and a rigid, generally triangularly shaped rear member residing in a parallel relationship with said front member and defining therewith a slot located on the hypotenuse of said triangularly shaped members, into which slot the corner of a photograph or poster can be inserted, said mounting corner being approximately 3/16 inch thick, and securing means on the exterior side of said rear member, whereby said corner can be readily attached to a mounting surface, said securing means involving a sharpened point adapted to be inserted into a corkboard or panel, said sharpened point being firmly mounted on a spring clip supported by the slot in said hypotenuse edge of said mounting corner.

3. A mounting corner to be utilized in groups for the mounting of photographs or posters, said corner comprising a thick, generally triangularly-shaped front member, and a thick, generally triangularly-shaped rear member, said members being of plastic, and residing together in a spaced, parallel relationship so as to define slot between said front and rear members that is located on the hypotenuse edge of said members, into which slot the corner of a photograph or poster can be inserted, and securing means affixed on the exterior side of said rear member, whereby a group of said corners can be grouped together to support the photograph or poster on a substantially flat surface, said securing means involving a sharpened point adapted to be inserted into a corkboard or panel, said sharpened point being firmly mounted on a spring clip supported by the slot in said hypotenuse edge of said mounting corner.

* * * * *